US007971980B2

(12) United States Patent
Jones et al.

(10) Patent No.: US 7,971,980 B2
(45) Date of Patent: Jul. 5, 2011

(54) SOLID INK STICK WITH REFLECTION FEATURES

(75) Inventors: Brent Rodney Jones, Sherwood, OR (US); Brian Walter Aznoe, Sherwood, OR (US); Jonathan Ryan Ritter, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 414 days.

(21) Appl. No.: 12/177,184

(22) Filed: Jul. 22, 2008

(65) Prior Publication Data

US 2010/0020143 A1 Jan. 28, 2010

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS 5,861,903 A * 1/1999 Crawford et al. ..... 347/88
5,975,688 A * 11/1999 Kanaya et al. ..... 347/86
6,213,600 B1 * 4/2001 Kobayashi et al. ..... 347/86
6,857,732 B2 2/2005 Jones et al.
6,874,880 B2 4/2005 Jones
6,893,121 B2 5/2005 Jones
7,063,412 B2 6/2006 Jones et al.
2007/0296780 A1 * 12/2007 Jones ..... 347/88
2007/0296782 A1 * 12/2007 Jones et al. ..... 347/88
2007/0296783 A1 12/2007 Jones et al.
2008/0012916 A1 1/2008 Jones
2008/0088685 A1 * 4/2008 Lucas et al. ..... 347/99
2010/0045756 A1 * 2/2010 Jones ..... 347/88

* cited by examiner

*Primary Examiner* — Matthew Luu
*Assistant Examiner* — Rut Patel
(74) *Attorney, Agent, or Firm* — Maginot, Moore & Beck LLP

(57) ABSTRACT

An ink stick for use in an imaging device comprises an ink stick body formed of a phase change ink material; and a reflection surface formed in the ink stick body. The reflection surface is configured to receive light from a light source associated with the reflection surface in an ink delivery system of a phase change ink imaging device. The reflection surface is configured to direct the light from the light source away from or onto one or both a first light detector and a second light detector associated with the reflection surface in the ink delivery system.

8 Claims, 8 Drawing Sheets

SOLID INK STICK WITH REFLECTION FEATURES

TECHNICAL FIELD

This disclosure relates generally to phase change ink jet printers, the solid ink sticks used in such ink jet printers, and the load and feed apparatus for feeding the solid ink sticks within such ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a print head for jetting onto a recording medium.

One difficulty faced in solid ink technology is differentiation and identification of ink sticks to ensure the correct loading and compatibility of an ink stick with the imaging device in which it is used. Provisions have been made to ensure that an ink stick is correctly loaded into the intended feed channel and to ensure that the ink stick is compatible with that printer. One such provision is directed toward physically excluding wrong colored or incompatible ink sticks from being inserted into the feed channels of the printer. For example, the correct loading of ink sticks has been accomplished by incorporating keying, alignment and orientation features into the exterior surface of an ink stick. These features are protuberances or indentations that are located in different positions on an ink stick. Corresponding keys or guide elements in the ink loader of the phase change ink printer exclude ink sticks which do not have the appropriate perimeter key elements while ensuring that the ink stick is properly aligned and oriented in the feed channel.

World markets with various pricing and color table preferences, however, have created a situation where multiple ink types may exist in the market simultaneously with nearly identical size/shape ink and/or ink packaging. Thus, ink sticks may appear to be substantially the same but, in fact, may be intended for different phase change printing systems due to factors such as, for example, market pricing or color table. Due to the broad range of possible ink stick configurations, marketing strategies, pricing, etc., differentiating the inks sticks so only appropriate ink is accepted by a printer requires methods of identification that go beyond physical keying.

SUMMARY

An ink stick has been developed that is configured to interact with a sensor system in an ink delivery system of a phase change ink imaging device to convey information pertaining to the ink stick to a control system of the imaging device. In particular, an ink stick for use in an imaging device comprises an ink stick body formed of a phase change ink material; and a reflection surface formed in the ink stick body. The reflection surface is configured to receive light from a light source associated with the reflection surface in an ink delivery system of a phase change ink imaging device. The reflection surface is configured to direct the light from the light source onto a first light detector associated with the reflection surface in the ink delivery system or to direct the light from the light source onto a second light detector associated with the reflection surface in the ink delivery system.

In another embodiment, a system for use in a phase change imaging device is provided. The system comprises a light source and at least a first light detector positioned in predetermined positions in an ink delivery system of the phase change ink imaging device. The system includes an ink stick formed of a phase change ink material and configured for insertion into the ink delivery system. The ink stick includes one or more reflection surfaces configured to receive light from the light source and to direct the light from the light source such that intended receiving detectors generate an electrical signal.

In yet another embodiment, an ink stick comprises an ink stick body formed of a phase change ink material; and at least one reflection surface formed in the ink stick body. Each reflection surface of the at least one reflection surface being configured to receive light from a light source associated with the reflection surface in an ink delivery system of a phase change ink imaging device. The reflection surface is configured to direct the light from the light source onto a predetermined one or more of a plurality of light paths which may be aligned away from or toward detectors associated with the reflection surface of the ink stick when positioned relative to the light source in the ink delivery system.

DETAILED DESCRIPTION OF THE PREFERRED EMBODIMENT

Figure 1:
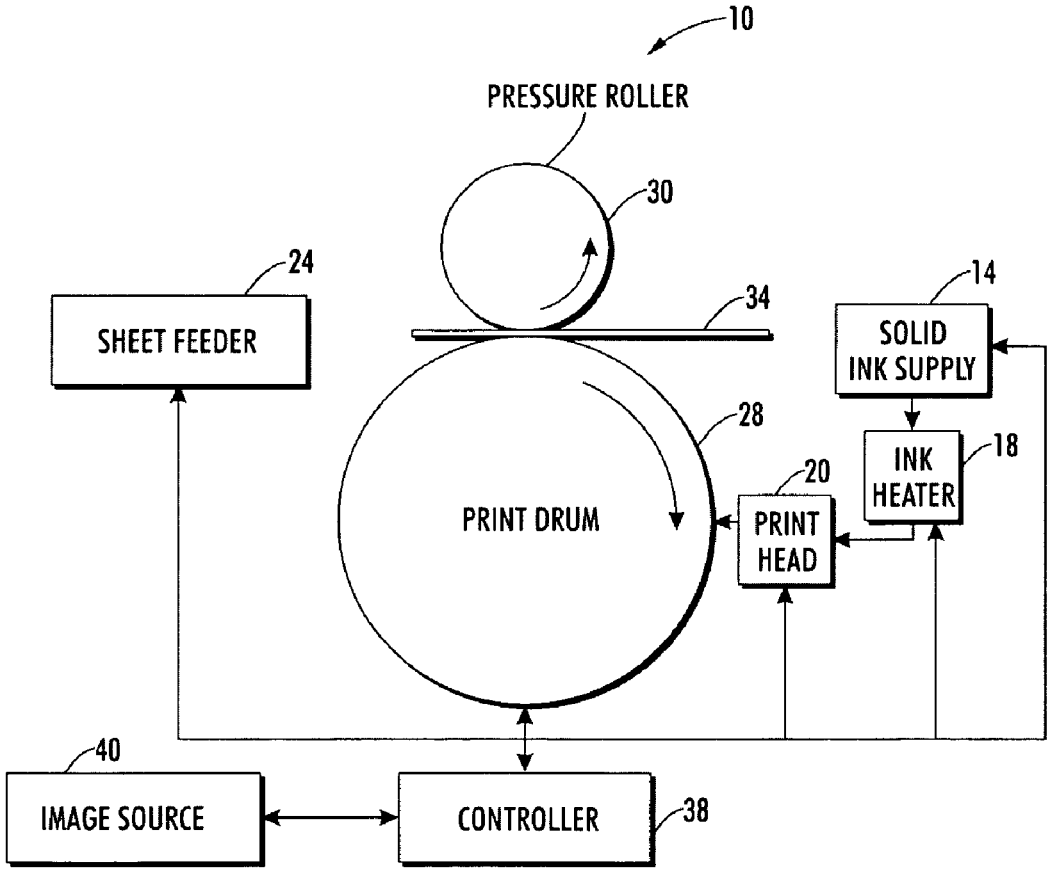
FIG. 1 PRIOR ART
FIG. 1 is a block diagram of a phase change ink imaging device.

For a general understanding of the present embodiments, reference is made to the drawings. In the drawings, like reference numerals have been used throughout to designate like elements. As used herein, the term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the present invention.

Referring now to FIG. 1, there is illustrated a block diagram of an embodiment of a phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment of FIG. 1 shows an indirect, or offset, printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling all or most of the other machine subsystems and functions, including the machine's printing operations, and, thus, includes the necessary hardware, software, etc. for controlling these various systems.

Figure 2:
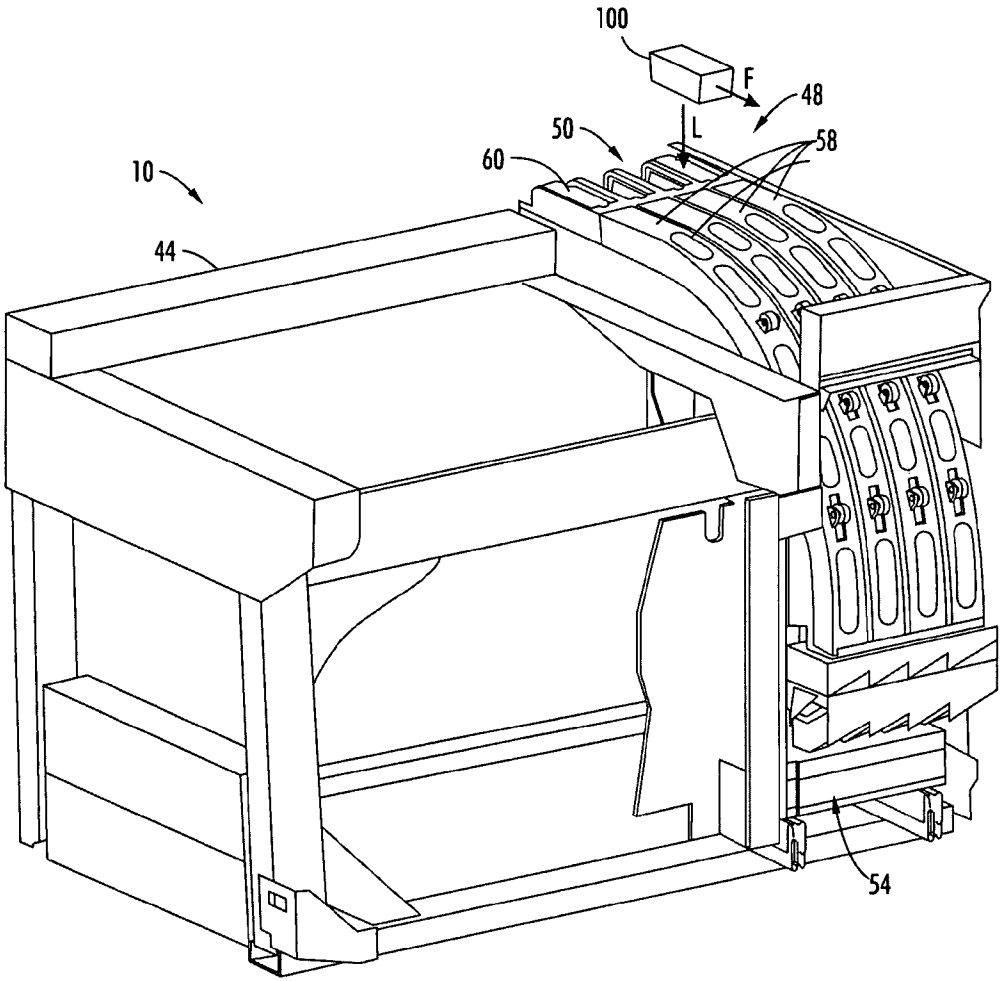
FIG. 2 is an enlarged partial top perspective view of an embodiment of an incomplete phase change ink imaging device with an ink loader.

Referring now to FIG. 2, the device 10 includes a frame 44 to which the operating systems and components are directly or indirectly mounted. A solid ink delivery system 48 advances ink sticks from loading station 50 to a melting station 54. The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc. The ink delivery system 48 includes a plurality of channels, or chutes, 58 for transporting ink sticks from the loading station 60 to the melting station 54. A separate channel 58 is utilized for each of the four colors: namely cyan, magenta, black and yellow. The melting station 54 is configured to melt the solid ink sticks and supply the liquid ink to a printhead system (not shown).

In the embodiment of FIG. 2, the loading station receives ink sticks inserted through the keyed openings 60 in an insertion direction L. The feed channels are configured to transport ink sticks in a feed direction F from the loading station to the melting station. In the embodiment of FIG. 2, the insertion and feed directions L and F are different. For example, ink sticks may be inserted in the insertion direction L and then moved along the feed channel in the feed direction F. In an alternative embodiment, the feed channels and keyed openings may be oriented such that the insertion and feed directions L and F are substantially parallel.

Figure 3:
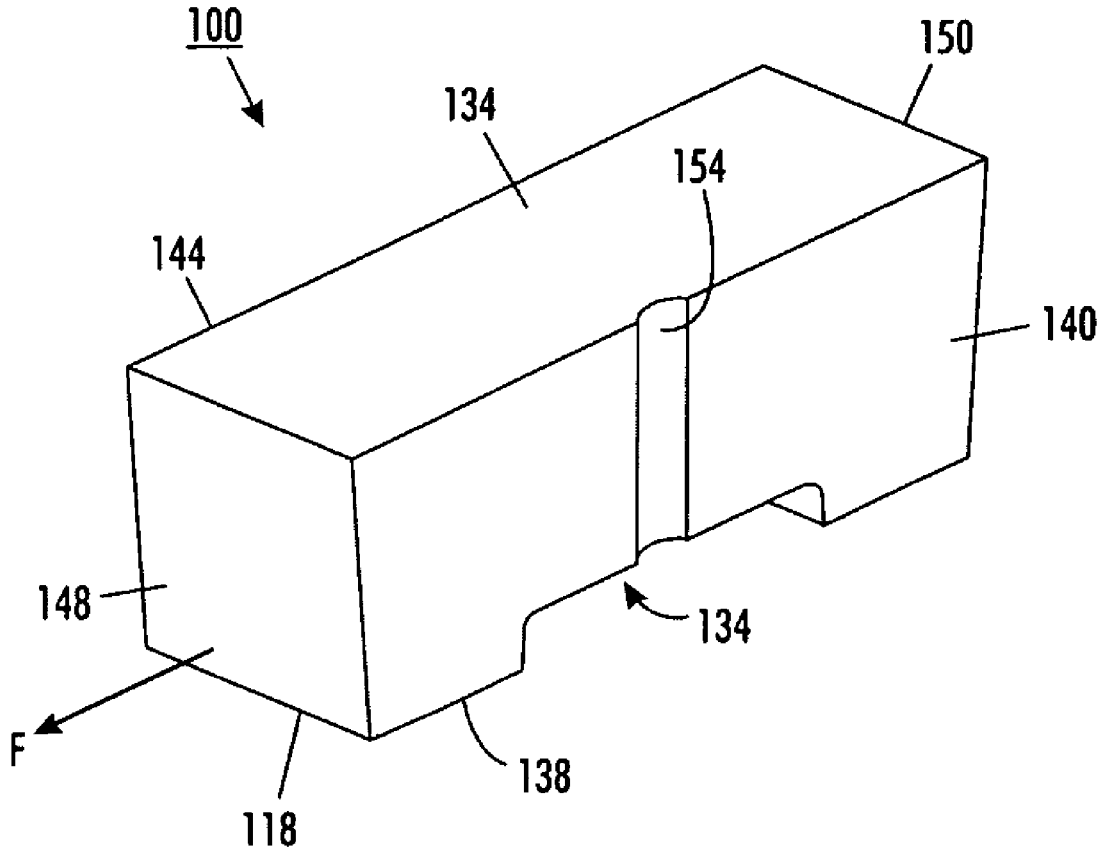
FIG. 3 is a perspective view of one embodiment of a solid ink stick.

An ink stick may take many forms. One exemplary solid ink stick 100 for use in the ink delivery system is illustrated in FIG. 3. The ink stick has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel one another, and are substantially perpendicular to the top and bottom surfaces 134, 138. The end surfaces 148, 150 are also basically substantially parallel one another, and substantially perpendicular to the top and bottom surfaces, and to the lateral side surfaces. One of the end surfaces 148 is a leading end surface, and the other end surface 150 is a trailing end surface. The ink stick body may be formed by pour molding, injection molding, compression molding, or other known techniques.

Ink sticks may include a number of features that aid in correct loading, guidance, sensing, and support of the ink stick when used. These functionally significant features may comprise contours such as protrusions and/or indentations that are located in different positions on an ink stick for interacting with key elements, guides, supports, sensors, etc. located in complementary positions in the ink delivery system. Sensing features may have multiple functions, such as interacting with one or more sensors and/or guiding, supporting, admitting and restricting insertion or feed.

Loading features may be categorized as insertion features or feeding features. Insertion features such as exclusionary keying elements and orientation elements are configured to facilitate correct insertion of ink sticks into the loading station and, as such, are substantially aligned with the insertion direction L of the loading station. As an example, the ink stick of FIG. 3 includes an insertion keying feature 154. The insertion keying feature is configured to interact with the keyed openings 60 of the loading station 50 to admit or restrict insertion of the ink sticks through the insertion opening 60 of the solid ink delivery system. In the ink stick embodiment of FIG. 3, the key element 154 is a vertical recess or notch formed in side surface 140 of the ink stick body substantially parallel to the insertion direction L of the loading station. The corresponding complementary key (not shown) on the perimeter of the keyed opening 60 is a complementary protrusion into the opening 60.

Although not depicted, the ink stick may include feeding features, such as alignment and guide elements, to aid in aligning and guiding ink sticks as they are moved along the feed channels to reduce the possibility of ink stick jams in the feed channel and to promote optimum engagement of the ink sticks with an ink melter in the ink melt assembly. Feed features may include configurations that permit or restrict the feed function of an inserted stick. Feeding features, therefore, may be substantially aligned with the feed direction F of the ink delivery system in order to interact with ink stick guides and/or supports in the ink delivery system. An ink stick may have any suitable number and/or placement of loading (i.e. insertion and/or feeding) features. Some of these features may be substantially perpendicular to one another, substantially aligned or have any other relationship.

In order to increase the ability of a printer control system to gain information pertaining to ink sticks that are utilized in the imaging device, ink sticks may be provided with sensor features for conveying ink stick data, or ink stick identifiers, to the print control system. Sensor features are configured to interact with a sensor system in the ink delivery system to generate one or more signals that correspond to the ink stick identifier(s). An ink stick identifier may comprise one or more values, alphanumeric characters, symbols, etc. that may be associated with a meaning by an imaging device control system. In one embodiment, information may be encoded into an ink stick by selecting at least one unique ink stick identifier to be indicated by the sensor features and implementing an encoding scheme such that the signals generated by sensor features on the ink stick corresponds to the ink stick identifier selected. In this way, sensor features may be used to embed information onto the ink stick that identifies the ink stick, such as a serial number, an identification code, or other index mechanism, an origin of the ink stick, ink stick formulation, date of manufacturing, marketing region or sales program, stock keeping unit (SKU) number, etc. An internal part number may be used in multiple SKU's, a package with one stick and a package of 4 identical sticks, as example. Ink stick identifiers may be read by an imaging device control system and translated into control and/or attribute information pertaining to the ink stick. For example, the control system may use the ink stick identifier as a lookup key for accessing data stored in a data structure, such as, for example, a database or table. The data stored in the data structure may comprise a plurality of possible identifiers with associated information corresponding to each identifier.

Any suitable encoding scheme may be implemented to embed one or more selected identifiers into the ink stick such as a binary encoding scheme. To implement a binary encoding scheme, sensor features are configured to interact with sensors to generate discrete binary signals, each binary signal having one of two possible values such as, for example, a "high" or "low" signal. When implementing a binary encoding scheme, the ink stick identifier indicated by the sensor features comprises one or more n-bit binary code words where n corresponds to the number of discrete binary signals that may be generated by the sensor features. Each discrete binary signal generated by the sensor features may correspond to a bit position in a binary code word and, thus, may be used to set or clear the bit in the corresponding bit position. Accordingly, with a sensor feature configured to generate n discrete binary signals, there are $2^n$ possible combinations of binary signals, or code words, which may be generated. For example, sensor features that are configured to generate three discrete binary signals may generate $2^3$, or 8, possible bit combinations, or code words, e.g., 000, 001, 010, 011, 100, 101, 110, and 111.

The nature of solid ink technology renders the addition of conventional labels or tagging mechanisms, such as barcode or RFID tags, for generating code words pertaining to an ink stick impractical. Accordingly, sensor features implemented in solid ink sticks are formed into or from the ink stick body itself. Each sensor feature is formed in a predetermined location on the ink stick and is configured to actuate or be detected by sensors in the ink delivery system. Sensor features may have any suitable configuration that permits reliable sensor actuation of a sensor or detector, directly or indirectly, such as by moving a flag or using an optical sensing system. For example, sensor features may comprise protrusions or indentations on the exterior surface of an ink stick. Some sensor features may have surfaces configured to reflect light from an optical source onto an optical detector.

To implement a binary encoding scheme using sensor features, each sensor feature may be configured to actuate sensors to generate signals, each signal having one of two possible values such as, for example, a "high" or "low" signal. This may be accomplished by configuring a sensor feature to set a flag or to not set a flag, or by configuring an element to reflect light onto a detector or to not reflect light onto a detector, etc. Each discrete binary signal generated by the sensor features may correspond to a bit position in a code word and, thus, may be used to set or clear the bit in the corresponding bit position.

In the least complex systems, there is a one to one correspondence between the number of sensor features and the number of discrete binary signals that can be generated by the sensor features. For example, each sensor feature would be configured to interact with a single sensor or detector to generate a single binary signal having a "high" or "low" value. Therefore, the total number of different ink stick identifiers that could be generated by this means is related directly to the number of sensor features formed in the exterior surface of the ink stick body. Accordingly, an ink stick that includes n sensor features is capable of generating $2^n$ possible ink stick identifiers. Four sensor features directing light either toward or away from corresponding detectors provide 16 possible variations, as example. The code word resulting from the various "high" and "low" value combinations correlates to a unique ink stick identification. A benefit of this identifying method is that the ink stick may be in a stationary position when the sensors are utilized for stick identification. In order to increase the number of ink stick identifiers that could be generated, the number of sensor features incorporated into an ink stick has to be increased. The number of positions on the exterior surface of an ink stick available for placement of sensor features, however, may be limited.

As an alternative to increasing the number of sensor features utilized on an ink stick to increase the number of possible ink stick identifiers that can be generated, sensor features in conjunction with a complementary sensor arrangement have been developed that enable a single sensor feature to selectively interact with a plurality of different sensors/detectors in an ink delivery system.

Figure 4:
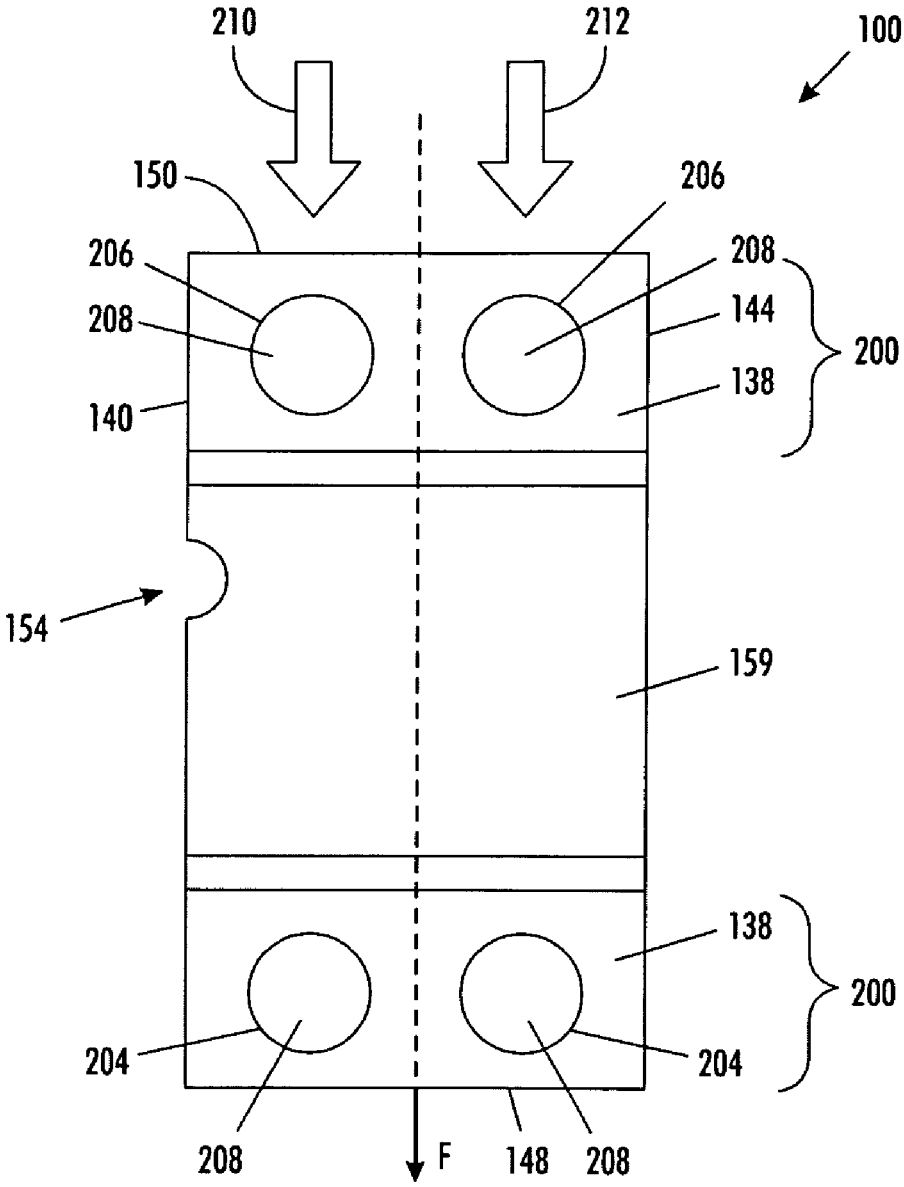
FIG. 4 is a bottom view of the ink stick of FIG. 3 showing sensor features having reflection surfaces formed in the bottom surface of the ink stick.

In one embodiment, an ink stick includes at least one sensor feature having a directed angle reflection surface that may be configured during fabrication of the sensor feature to reflect or direct incident light onto one of a plurality of different detectors. The term reflection surface generally refers to an added feature or modified nominal surface to become a sensor feature though, in some cases, the unmodified surface could be the surface that directs light onto one or more detectors and when the sensor feature reflection surface is placed there, light is directed away from one or more detectors. Referring to FIG. 4, there is shown an embodiment of an ink stick that includes sensor features 204, 206 having reflection surfaces 208. The sensor features may be formed in any suitable location on the ink stick including the same or multiple surfaces of the ink stick. In the embodiment of FIG. 4, the ink stick includes four sensor features 204, 206 positioned on the bottom surface 138 of the ink stick. In one embodiment, as shown in FIG. 4, the reflection surfaces are formed in insets, termed herein "pockets," that may have any suitable depth as extending from the origin of the angled/contoured reflection surface. Deeper pockets may add reliability as the reflection surface is less vulnerable to being damaged or chipped when the stick is mishandled. Reflection surfaces may be configured with the suitable angle, orientation, and/or reflective properties capable of reflecting or directing a suitable amount of light onto an associated detector, or to reflect or direct light away from an associated detector or detectors. Detectors receiving sufficient reflected light generate an electrical signal that may be used by a control system to identify identification characteristics of the ink sticks.

A sensor system is positioned in the ink delivery system to read the code word(s) embedded in the sensor features. As explained below, the sensor system includes at least one light source associated with each sensor feature for directing light in a known manner onto the reflection surface of the respective sensor feature. In order to minimize the number of light sources and detectors required to read the ink stick identifier embedded in the ink stick, the sensor features may be arranged in one or more linear arrays, or tracks, with each track 210, 212 forming a path substantially parallel to the feed direction F of the ink delivery system. The four sensor features 204, 206 of the ink stick of FIG. 4 are arranged in two tracks with the sensor features 204 comprising leading end sensor features of their respective tracks and the sensor features 206 comprising trailing end sensor features of their respective tracks. By arranging the sensor features in tracks parallel to the feed direction, each sensor feature in a track may be illuminated by a single light source as the ink stick is moved along a feed channel in the ink delivery system. Instantaneous identification of the ink sick based on detection of the sensor feature set may be accomplished in one stationary position by placing the appropriate light sources and detectors at each of the applicable locations.

Referring now to FIGS. 5*a*-5*d*, there is shown cross-sectional views of an exemplary sensor feature 204 and an associated sensor arrangement for interacting with the sensor feature that depicts how a reflection surface of a sensor feature may be configured to interact with multiple detectors. As mentioned above, each sensor feature is associated with a light source 218 that is positioned in the ink delivery system to direct light onto the reflection surface 208 of the sensor feature. At least a first 220 and a second light detector 224 are associated with each light source that are configured to detect light reflected from the reflection surface 208, and to generate a reflectance signal indicative of the reflectance value or intensity of the light reflected thereon by the reflection surface 208.

The reflection surface may be fabricated to direct light onto the first detector or to direct light onto the second detector. For example, in FIG. 5*a*, the reflection surface 208 of the sensor feature 204 is oriented or angled to direct light onto the first detector 220. Similarly, in FIG. 5*b*, there is shown a reflection surface 208 that is configured to reflect light onto the second detector 224. A reflection surface configured to direct light onto a detector may be angled as a flat surface or may be an angled contour that maximizes directional reflectance. To facilitate optical detection, reflection surfaces may be treated or coated with, for example, a retro-reflective coating to enhance the reflective property of the surface. Coatings, surface texture, depth and contours of the reflective surface can be incorporated as appropriate to the light wavelength, reflective properties of the material, electronic circuit, apertures or other system considerations or elements. Reflected light intensity may be intentionally reduced by employing coatings, localized dopants, angles, surface topography or other surface characteristics. Reduced reflected light intensity in regions surrounding the reflecting surface would improve discretion between detectors. Reduced reflectivity of a reflection surface would provide a modified signal strength from the detector electrical circuit, such as lower voltage. Reflection modification or control may be used to influence the amount of light directed to one or more sensors. As example, a sensor feature in stick "A" might be configured to reflect light to the highest extent reasonably capable with a given set of parameters while stick "B" employs light reflection reducing topography for that feature, providing a reduction of reflected light to the detector and consequently, the means to determine the difference between the two based on a characteristic of the electronic signal. Detector signal strength variations may be segmented into more than the two example divisions. This method of adding further variability to the sensor identifiers is applicable to all sensor/feature configurations encompassed by this concept.

Figure 5A:
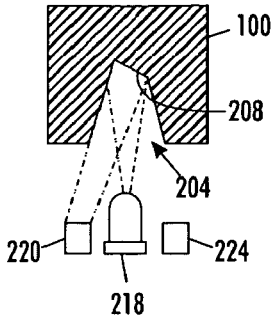
FIG. 5*a* is a cross-sectional view of one embodiment of a sensor feature of that includes a reflection surface configured to reflect light onto a first detector of a pair of detectors.
Figure 5B:
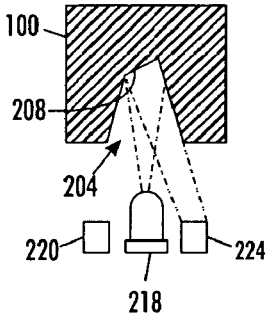
FIG. 5*b* is a cross-sectional view of a sensor feature that includes a reflection surface configured to reflect light onto a second detector of a pair of detectors.
Figure 5C:
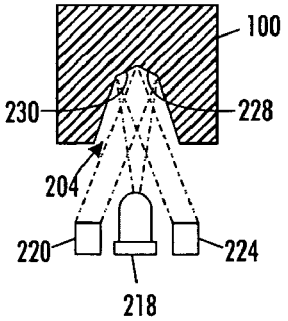
FIG. 5*c* is a cross-sectional view of a sensor feature that includes a reflection surface configured to reflect light onto both the first and second detectors.
Figure 5D:
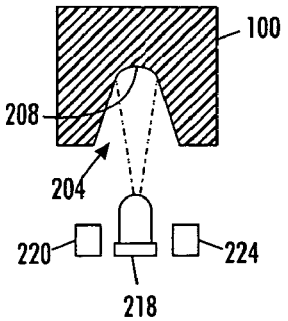
FIG. 5*d* is a cross-sectional view of sensor feature that includes a reflection surface configured to reflect light away from one or any number of detectors.

In another method to expand the number of possible values that may be generated by a reflection surface, reflection surfaces may be configured to direct light onto multiple detectors or to direct light away from detectors. For example, a reflection surface may be faceted to direct light in more than one direction as depicted in FIG. 5*c*. FIG. 5*c* shows a reflection surface that includes a first facet 228 configured to direct light onto the first detector 220 and a second facet 230 configured to direct light onto the second detector 224. FIG. 5*d* shows the case of a reflection surface that is configured to not reflect light or to reflect light away from the one or more associated detectors. In this case, nominal reflection of light absent the inset reflection surface would be toward one or more sensors. This example serves to illustrate that a reflection surface which directs light away from one or more detectors can be equivalent in function to a surface that directs light toward one or more detectors. The reflection surface may have any suitable configuration that is capable of performing the function of directing light away from the detectors. For example, in FIG. 5*d*, the reflection surface 208 is embodied as a concave surface that is configured to limit the amount of light reflected onto the detectors 220, 224.

In addition, although each reflection surface has been described as being configured to interact with two detectors in an ink delivery system, any suitable number of detectors may be associated with a reflection surface. For example, in one embodiment, a radial pattern of detectors may be positioned about a light source. A reflection surface may be configured to direct light onto any one or more of the detectors associated with the reflection surface.

Sensor features with reflection surfaces may be formed in an ink stick in any suitable manner. For example, sensor features may be formed in ink sticks by incorporating an appropriately contoured mold pins into the mold cavity in suitable locations that may be oriented or turned in different directions for different part numbers to form facets of reflection surfaces that are capable of directing light in desired directions. By using a rotating mold pin to form angled reflection surfaces, the angle of orientation of the mold pin may be the only tool change needed to reconfigure the sensor features from ink stick to ink stick. In addition, mold pins, as an insert, may be easily replaced to change the number and/or configuration of the reflection surfaces. In addition, although a binary encoding scheme has been described, any suitable encoding scheme may be implemented in the sensor features. For example, by configuring the reflection surfaces of the sensor features to reflect light onto a detector to produce three or more possible signal values, base three and higher level encodings may be implemented.

In the embodiment of FIGS. 5*a*-5*d*, light sources 218 of a code reader may comprise a light emitting diode (LED) or laser diode and may include a collimating lens (not shown) which collimates the beam emitted from the LED or laser diode toward a focus point in which the beam impinges on a reflection surface on the ink stick. Light sources, however, may be any suitable type of light source including, for example, visible, infrared, or ultraviolet light or any combination thereof. The detectors 220, 224 of FIGS. 5*a*-5*d* may comprise, for example, any suitable type of photo detector or photo receptor selected to complement the wavelength or wavelength range of the light source and the expected light reflectance or intensity values off each color of ink. The detectors may include lenses or amplifiers (not shown) for amplifying the detected signal and/or an optical filter (not shown) tuned to the wavelength of light emitted by the light source for eliminating stray light.

The light sources and detectors of a code reader may be positioned in any suitable location in the ink delivery system. For example, the light sources and detectors are positioned adjacent the bottom of the feed channel for sensing the sensor features in or near the bottom surface of the ink stick. The light sources and detectors of the code reader may be positioned near a common entry or the insertion area of each feed channel so the insertion itself or any forward movement from the insertion area may initiate the "reading" of the sensor features of the ink stick. Sensing functions in the channel, however, may occur one or more times at one or more positions along the path of travel of the ink stick.

In one embodiment, each detector may be configured to generate a signal having one or two possible values, e.g., "high" and/or "low" signals, based on reflectance or light intensity values of light reflected thereon by the reflection surface. For example, a detector that is configured to receive reflected light from a reflection surface may be configured to produce a "high" signal output (or 1) while the detectors that do not receive reflected light may be configured to generate a "low" signal output. Any suitable method may be used to generate the appropriate "high" and "low" signals. For example, in one embodiment, the detectors are configured to generate reflectance signals indicative of the intensity of the light incident upon the detector. The control system is configured to receive the reflectance signals and to compare the light reflectance or intensity values indicated by the reflectance signals to a suitable threshold value or threshold value range.

Accordingly, sensor features having reflection surfaces may be used to implement a binary, variable or other encoding scheme. To implement a binary encoding, each detector associated with a particular sensor feature may correspond to a different bit position in a code word array. For example, the "high" or "low" signals generated by the interaction between the reflection surfaces and the detectors may be provided as inputs to predetermined bit positions in an input register, stored in memory, etc. that is accessible by the control system. The bit at each respective bit position may be set or cleared based the value of the output signals from the detectors associated with each bit position. For example, a "high" output signal from a detector may be used to set the bit at the associated bit position in the code word array, and "low" output signal from a detector may be used to clear the bit at the associated bit position in the code word array. Of course, sensor states of high and low may be inverted in a particular implementation without affecting the functionality of the sensor features. Thus, the number of possible ink stick identifiers that may be generated using sensor features having reflection surfaces may then be $2^m$ where m corresponds to the total number of detectors that are configured to interact with the reflection surfaces of an ink stick. In the embodiment of FIG. 4, in which the ink stick includes four sensor features, each sensor feature having a reflection surface configured to interact with two detectors, a total of 8 possible detectors are associated with the ink stick. Therefore, the total number of different code words that may be embedded into the sensor features may be approximately $2^4$ when only one of each pair of detectors may receive reflected light and $3^4$ when either one or both of the detectors may receive reflected light. Another similar example would be two light sources each related to four detectors where reflected light would be directed to any one or two of the detectors for each light source, providing $8^2$ such possibilities. For simplicity, the number of possible code words or identification variations in the given examples do not include cases of blocked reflection (no detection) or various levels of reflection strength (different detector signal levels), however the number of possibilities could be increased by employing those methods. Not all possible ink stick identifiers need to be predefined. Some identifiers may be reserved for later use or allowed for in subsequent products where the only required system change might be new firmware, minimizing implementation cost.

As mentioned above, ink stick identifiers may be assigned to indicate information pertaining to the ink stick, such as color, a serial number, an identification code, or other index mechanism, an origin of the ink stick, ink stick formulation, date of manufacturing, marketing region or sales program, stock keeping unit (SKU) number, etc. Information may be encoded into the ink stick by selecting the appropriate ink stick identifier to be indicated by the sensor features of an ink stick and fabricating the reflection surfaces of the sensor features to reflect light onto the appropriate detectors to generate the signals corresponding to the selected ink stick identifier. Detectors are described as generating a signal based on receiving reflected light but it is to be understood that the detector functions in conjunction with the associated electrical circuit or driving power source and that the signal received by a controller may be further conditioned for interpretation.

The control system having access to the ink stick identifier generated by the sensor features of an ink stick may compare the generated ink stick identifier to data stored in a data structure, or table. The data stored in the data structure may comprise a plurality of possible ink stick identifiers with associated information corresponding to each value. The associated information may comprise control/attribute information that pertains to the ink stick. The imaging device controller may then enable or disable operations, optimize operations or influence or set operation parameters based on the control/attribute information associated with each ink stick identifier. For example, if an ink stick identifier indicates that an ink stick is not compatible with or not intended to be used with the imaging device, the control system may generate an alert signal or message to an operator and/or service personnel.

As mentioned above, sensor features may be arranged in tracks so that a single light source and associated detectors may be used to read each sensor feature of a track. To differentiate between detector actuations caused by sensor features in a track, the ink stick may be provided with one or more transition indicators 134 as depicted in FIGS. 3 and 4. Transition indicators, such as the transition indicator 134, are configured to provide an indication to the control system that the leading sensor features 204 have passed the sensor region and that subsequent detector actuations that may occur are due to the trailing sensor features 206 of the tracks. The use of a transition indicating region 134 between the leading sensor features and the trailing sensor features enables a distinction to be made between the actuations of the detectors by leading end sensor features and trailing end sensor features despite variations in the rate and timing that ink sticks may traverse the sensor region in a feed channel so that a single light source and associated detectors combination may be used to interact with a particular track. Transition indicating regions may be present on one sensor track and not present in another sensor track. Multiple regions or segments may be used in one or more tracks. Transition indicators may have curved, angled, or rounded surfaces or any combination of these surfaces so long as the transition indicating region is capable of interacting with the sensors to provide the indication of a transition from segment to segment, such as the leading to the trailing sensor actuators.

Although the ink stick sensor features described above have been described as being inset or recessed into surfaces of the ink stick, sensor features may be provided in ink sticks that are formed into or intersecting with other features formed into the ink stick. FIGS. 6-9 show an embodiment of ink stick sensor features 204 that may be incorporated into ink sticks 100' as recesses into a feed key feature 240. As mentioned above, ink sticks may include feeding features that are configured to interact with key elements, alignment, and/or guiding features formed in a feed channel. Feeding features, therefore, may be substantially aligned with the feed direction F of the ink delivery system in order to interact with ink stick guides and/or supports in the ink delivery system. The ink stick of FIGS. 6-9 includes a feed key feature 240 that comprises a longitudinal recess in the ink stick body. The longitudinal recess extends along the length of the ink stick body, or at least that portion of the length that is configured to follow a path that will intersect the corresponding feed channel key 244 in the feed channel 58 (FIG. 7). As seen in FIG. 7, the longitudinal recessed ink stick key element 240 extending along the entire length of the ink stick body permits the ink stick 100' to pass the corresponding key 244 in the feed channel as the ink stick moves along the feed channel. The feed channel key 244 blocks passage along the feed channel of an ink stick that does not have an ink stick feed key element 240 complementary to the feed channel key 244. The feed keying feature in the ink need not be the same shape or size or be in the same position as portions of the channel feed key to be effective. As seen in FIG. 7, the feed channel key 244 projects from one of the side walls 56 of the feed channel 58 but does not extend to the same depth as the ink stick key feature 240.

Figure 6:
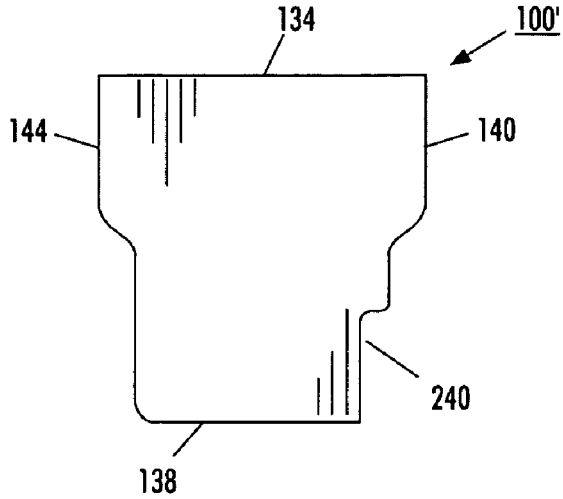
FIG. 6 is an end view of another embodiment of ink stick including a feed key feature.
Figure 7:
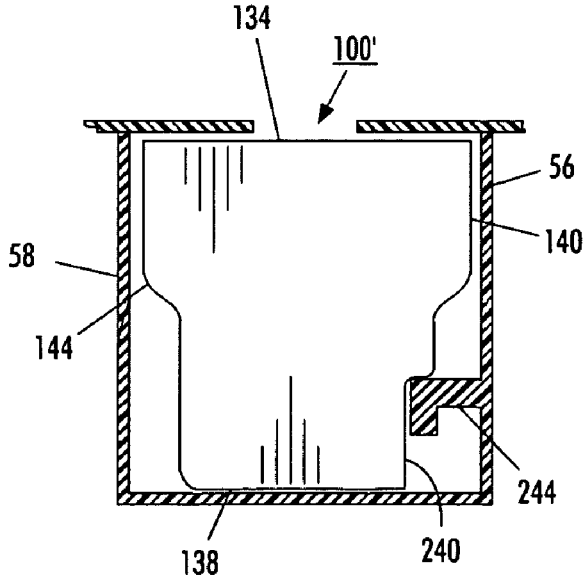
FIG. 7 shows the ink stick of FIG. 6 in a corresponding feed channel having a feed channel key.
Figure 8:
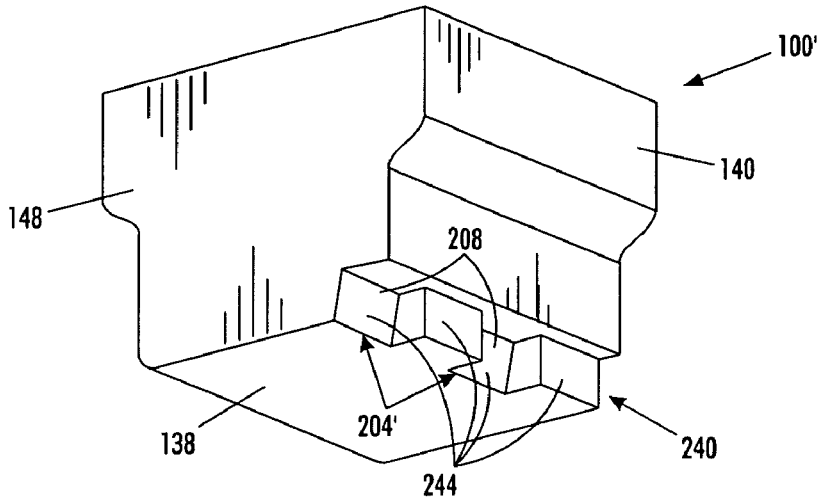
FIG. 8 is a perspective view of the ink stick of FIG. 6 showing sensor features.

FIG. 8 shows the ink stick of FIG. 6 in which sensor features 204' of the ink stick are formed as insets into the feed key feature 240 of the ink stick. As can be seen in the embodiment of FIG. 5, the sensor features 204' are formed so as not to extend into the region that defines the feed key shape so as not to come into contact with the feed channel key 244 of the feed channel 58. In this embodiment in which the feed channel key 244 extends along the side surface, the sensor features 204' are inset at least partially into the feed key feature 240 that extends along the side surface 140 of the ink stick and extends through or breaks out of the bottom surface 138 of the ink stick. Although the sensor features 204' of FIG. 8 are shown as being formed into an ink stick feed key feature 240, sensor features may be formed into or intersecting with substantially any feature that may be formed on an ink stick including insertion key features, guide or alignment features. The sensor features may be formed in any feature along substantially any surface of the ink stick that permits reliable sensor actuation without the sensor feature interfering with the insertion, feed, alignment, or guidance of the ink stick in the ink delivery system.

Figure 8A:
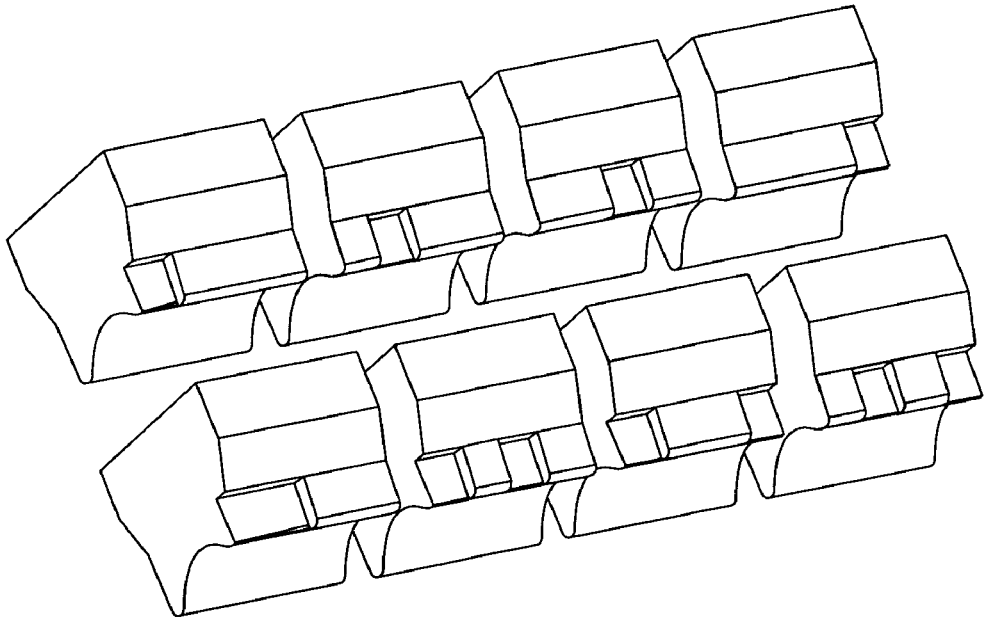
FIG. 8*a* is a perspective view of a plurality of ink sticks similar to the ink stick of FIG. 8 showing some possible variations in the arrangement of sensor features.

As best depicted in FIG. 8, the ink stick 100' includes a plurality of potential sensor feature locations 244 that are arranged along the longitudinal length of the ink stick feed key 240. There are four potential sensor feature locations 244 along the feed key 240 of the ink stick of FIG. 8 although there may be any suitable number of sensor feature locations on the ink stick. FIG. 8*a* shows a plurality of ink sticks that show possible variations of the placement or arrangement of the sensor features at the potential locations.

Similar to the ink stick sensor features described above, the sensor features 204' of FIG. 8 include a reflection surface 208 that may be arranged or oriented during fabrication to reflect or direct incident light from an associated light source in a feed channel onto or away from one or more detectors. The reflection surface 208 of a sensor feature 204' may be oriented substantially toward a lateral side of the feed channel for interacting with a corresponding sensor arrangement positioned along that side of the channel. However, the sensor feature may be formed in any surface and be positioned or oriented in any suitable direction for interacting with a sensor arrangement in any suitable position in the channels.

Figure 9:
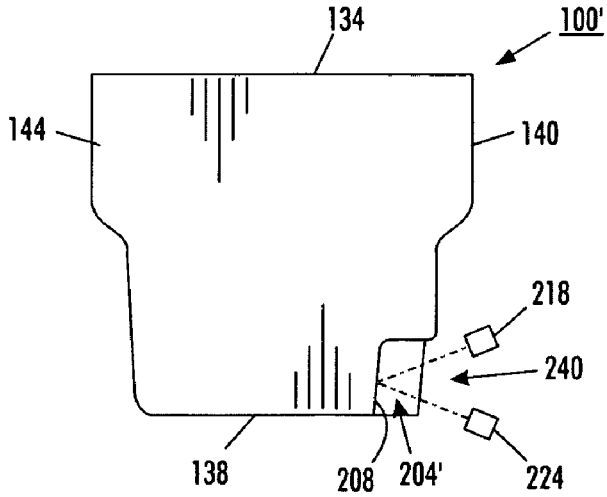
FIG. 9 is an end view of the ink stick of FIGS. 6-8 and one embodiment of a sensor arrangement for interacting with the sensor features.
Figure 10:
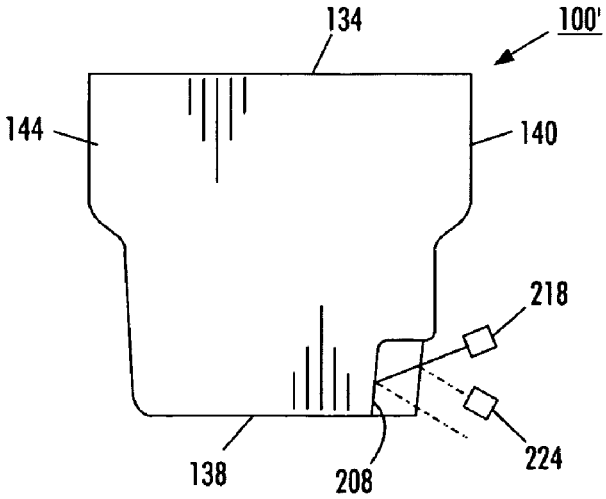
FIG. 10 is an end view of the ink stick of FIGS. 6-8 and another embodiment of a sensor arrangement for interacting with the sensor features.

The reflection surfaces 208 of the sensor features 204' of FIG. 8 may be configured with the suitable angle, orientation, and/or reflective properties capable of reflecting or directing a suitable amount of light from a light source 224 onto an associated detector 224 (FIG. 9), or to reflect or direct light away from an associated detector 224 detectors (FIG. 10). FIG. 9 shows an embodiment of a reflection surface that is configured to direct light onto one or more associated detectors. Detectors receiving sufficient reflected light generate an electrical signal that may be used by a control system to identify identification characteristics of the ink sticks. Similar to embodiments described above, the sensor features 204' of the ink stick 100' of FIGS. 6-9 may be configured to actuate sensors to generate a unique pattern of signals corresponding to ink stick identifiers by forming sensor features at the potential sensor feature locations 244 on the ink stick in different combinations of locations and by configuring the sensor features 204' to direct light from a light source onto or away from one or more light detectors 224 associated with the sensor feature in a feed channel.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink stick for use in an imaging device, the ink stick comprising:

an ink stick body formed of a phase change ink material, an ink stick identifier associated with the ink stick, the ink stick identifier being a first ink stick identifier or a second ink stick identifier; and at least two reflection surfaces formed in the ink stick body, each reflection surface being configured to receive light from a light source associated with the reflection surface in an ink delivery system of a phase change ink imaging device, each reflection surface being configured to direct the light from the light source onto or away from a first light detector associated with the reflection surface in the ink delivery system or to direct the light from the light source onto or away from a second light detector based on correlation of the ink stick identifier with the at least two reflection surfaces to enable the first or the second light detector to generate an electrical signal having different signal characteristics indicative of the amount of light directed on either the first light detector or the second light detector by the reflection surface.

2. The ink stick of claim 1, the ink stick identifier associated with the ink stick body comprising a stock keeping unit (SKU) or part number corresponding to the ink stick body.

3. The ink stick of claim 1, the ink stick identifier associated with the ink stick body being the first ink stick identifier, the second ink stick identifier, or a third ink stick identifier;

the at least two reflection surfaces being configured to direct the light from the light source onto or away from a third light detector associated with the at least two reflection surfaces in the ink delivery system if the ink stick identifier associated with the ink stick body corresponds to the third ink stick identifier.

4. The ink stick of claim 1 further comprising:

a feed key feature formed in the ink stick body; and the at least two reflection surfaces being formed as an inset in the feed key feature formed in the ink stick body.

5. A system for use in a phase change imaging device, the system comprising:

a light source and at least one light detector positioned in predetermined positions in an ink delivery system of the phase change ink imaging device;

an ink stick formed of a phase change ink material and configured for insertion into the ink delivery system, the ink stick including an ink stick identifier associated with the ink stick, the ink stick identifier being a first ink stick identifier or a second ink stick identifier and the ink stick also including a plurality of reflection surfaces configured to receive light from the light source and to direct the light from the light source onto or away from a first light detector or to direct the light from the light source onto or away from a second light detector based on correlation of the ink stick identifier with the reflection surfaces to enable the first or the second detector to generate an electrical signal having different signal characteristics indicative of the amount of light directed on either the first light detector or the second light detector by the reflection surface.

6. The system of claim 5, the ink stick identifier associated with the ink stick comprising a stock keeping unit (SKU) or part number corresponding to the ink stick.

7. The system of claim 5 further comprising:

a control system configured to receive the electrical signals generated by either the first or the second light detectors and to determine the ink stick identifier associated with the ink stick based on characteristics of the electrical signals from either the first or the second light detectors.

8. The system of claim 7, the control system being configured to influence imaging operations of the phase change ink imaging device based on the ink stick identifier determined by the control system.

* * * * *